US009976730B1

(12) United States Patent
Deng

(10) Patent No.: US 9,976,730 B1
(45) Date of Patent: May 22, 2018

(54) QUICK INSTALLATION LED LAMP

(71) Applicant: DONGGUAN PAN AMERICAN ELECTRONICS CO., LTD, DongGuan (CN)

(72) Inventor: Jinsheng Deng, DongGuan (CN)

(73) Assignee: DONGGUAN PAN AMERICAN ELECTRONICS CO., LTD, Dongguan, Guangdong (CN)

( * ) Notice: Subject to any disclaimer, the term of this patent is extended or adjusted under 35 U.S.C. 154(b) by 0 days. days.

(21) Appl. No.: 15/613,640

(22) Filed: Jun. 5, 2017

(30) Foreign Application Priority Data

Mar. 24, 2017 (CN) ..... 2017 2 0300593 U

(51) Int. Cl.

| | |
|---|---|
| ***F21V 21/08*** | (2006.01) |
| ***F21V 23/06*** | (2006.01) |
| ***F21V 3/02*** | (2006.01) |
| ***F21V 17/16*** | (2006.01) |
| ***F21V 23/02*** | (2006.01) |
| *F21Y 115/10* | (2016.01) |
| *F21Y 103/10* | (2016.01) |

(52) U.S. Cl.

CPC ..... *F21V 21/08* (2013.01); *F21V 3/02* (2013.01); *F21V 17/16* (2013.01); *F21V 23/023* (2013.01); *F21V 23/06* (2013.01); *F21Y 2103/10* (2016.08); *F21Y 2115/10* (2016.08)

(58) Field of Classification Search

CPC ..... F21V 21/08; F21V 23/023; F21V 23/06; F21V 3/02; F21V 17/16; F21V 15/015; F21V 21/005; F21Y 2103/10; F21Y 2115/10

See application file for complete search history.

(56) References Cited

U.S. PATENT DOCUMENTS

| | | | | |
|---|---|---|---|---|
| 6,341,875 | B1 * | 1/2002 | Chu | F21V 19/006 362/249.06 |
| 7,070,418 | B1 * | 7/2006 | Wang | F21K 9/00 439/56 |
| 7,703,941 | B2 * | 4/2010 | Lee | G09F 9/33 362/217.17 |
| 8,556,454 | B2 * | 10/2013 | Pei | F21V 23/02 362/217.01 |
| 8,764,220 | B2 * | 7/2014 | Chan | F21V 15/013 362/217.02 |
| 9,752,735 | B2 * | 9/2017 | Chamberlain | F21K 9/275 |
| 2009/0093156 | A1 * | 4/2009 | Li | F21V 19/0005 439/602 |
| 2009/0296381 | A1 * | 12/2009 | Dubord | F21S 2/005 362/218 |

(Continued)

*Primary Examiner* — Joseph L Williams
*Assistant Examiner* — Jose M Diaz
(74) *Attorney, Agent, or Firm* — Polsinelli PC

(57) ABSTRACT

A quick installation LED lamp includes an aluminum profile having a groove on a top thereof, the aluminum profile being provided with an abutting portion on a bottom thereof; a light source assembly received in the groove, the light source assembly comprising a support strip and a plurality of LED beads arranged spaced and equidistantly on the support strip; a lampshade mounted on the aluminum profile and covering the light source assembly; a connector assembly, and a fixing piece having a base plate and the two side plates extending upwardly from both sides of the base plate, wherein the side plate has a bending portion latching with the abutting portion.

7 Claims, 10 Drawing Sheets

(56) References Cited

U.S. PATENT DOCUMENTS

| | | | | |
|---|---|---|---|---|
| 2010/0053956 | A1* | 3/2010 | Park | F21K 9/00 362/235 |
| 2010/0124053 | A1* | 5/2010 | Wu | F21S 2/00 362/219 |
| 2011/0164407 | A1* | 7/2011 | Stack | A47F 3/001 362/125 |
| 2011/0286207 | A1* | 11/2011 | Chan | F21V 15/013 362/217.1 |
| 2012/0008315 | A1* | 1/2012 | Simon | F21V 21/005 362/217.13 |
| 2012/0051052 | A1* | 3/2012 | Wagatsuma | F21V 19/0025 362/249.01 |
| 2012/0092875 | A1* | 4/2012 | Cho | F21S 2/005 362/311.01 |
| 2015/0049485 | A1* | 2/2015 | Kamitani | F21V 23/06 362/249.01 |
| 2015/0338053 | A1* | 11/2015 | Rector | F21V 5/02 362/224 |
| 2015/0338068 | A1* | 11/2015 | Bolscher | F21V 21/005 362/219 |
| 2016/0025324 | A1* | 1/2016 | Huang | F21V 31/00 362/249.02 |
| 2017/0051905 | A1* | 2/2017 | Luu | F21V 21/005 |
| 2017/0370567 | A1* | 12/2017 | Zheng | F21S 4/28 |
| 2018/0003351 | A1* | 1/2018 | Van Winkle | F21V 29/70 |

* cited by examiner

QUICK INSTALLATION LED LAMP

CROSS REFERENCE TO RELATED APPLICATION

This application claims the benefit of Chinese Application No. 2017203005932, filed Mar. 24, 2017, the entire content of which is incorporated herein in its entirety.

FIELD OF THE INVENTION

The present disclosure relates to the field of home lighting technology, and more particularly relates to a quick installation Light Emitting Diode (LED) lamp.

BACKGROUND OF THE INVENTION

As a new type of light source, LED lamps have shown their wide range of applications due to the features such as energy saving, high efficiency and low cost, etc. In more and more applications, users prefer to use LED lamps to replace the traditional fluorescent lamps.

The conventional T5 fluorescent fight employs such a design that the lamp tube and the bracket are separated, while the lamp tube is made of semi-aluminum semi-plastic. However, due to the limitation of the lamp size, and the small parts of the lamp tube, it is inconvenient to install the LED lamp.

Therefore, there is room for improvement within the art.

SUMMARY OF THE INVENTION

The present disclosure is directed to a quick installation LED lamp, which is simple to assemble, thus saving installation time.

A quick installation LED lamp includes: an aluminum profile having a groove on a top thereof, the aluminum profile being provided with an abutting portion on a bottom thereof; a light source assembly received in the groove, the light source assembly comprising a support strip and a plurality of LED beads arranged spaced and equidistantly on the support strip; a lampshade mounted on the aluminum profile and covering the light source assembly; a connector assembly comprising: a male end cap located at one end of the aluminum profile, the male end cap being provided with a first plug having a plurality of first jacks; a female end cap located at the other end of the aluminum profile, the female end cap being provided with a first receptacle, the first receptacle being provided with a plurality of first pins mounted therein; and a connector comprising a second plug and a second receptacle opposite to the second plug, the second plug having a plurality of second jacks, the second receptacle being provided with a plurality of second pins mounted therein; wherein the second plug is configured to be inserted into the first receptacle; the plurality of first pins are accommodated in the second jackets; the second receptacle is configured to accommodate the first plug; the plurality of first second pins are inserted in the first jackets; and a fixing piece having a base plate and the two side plates extending upwardly from both sides of the base plate, wherein the side plate has a bending portion latching with the abutting portion.

These and other objects, advantages, purposes and features will become apparent upon review of the following specification in conjunction with the drawings.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

Reference will now be made to the drawings to describe, in detail, embodiments of the present quick installation LED lamp. It should be noted that references to "an" or "one" embodiment in this disclosure are not necessarily to the same embodiment, and such references mean at least one.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
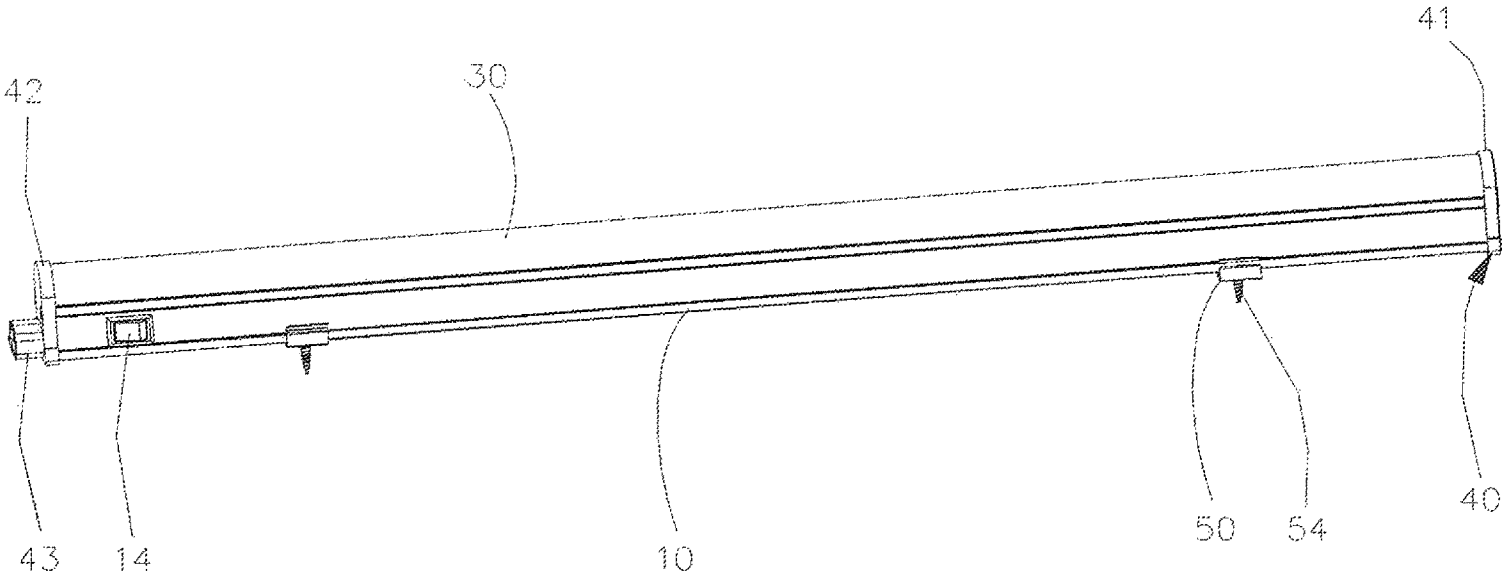
FIG. 1 is a perspective view of a quick installation LED lamp according to an embodiment.
Figure 2:
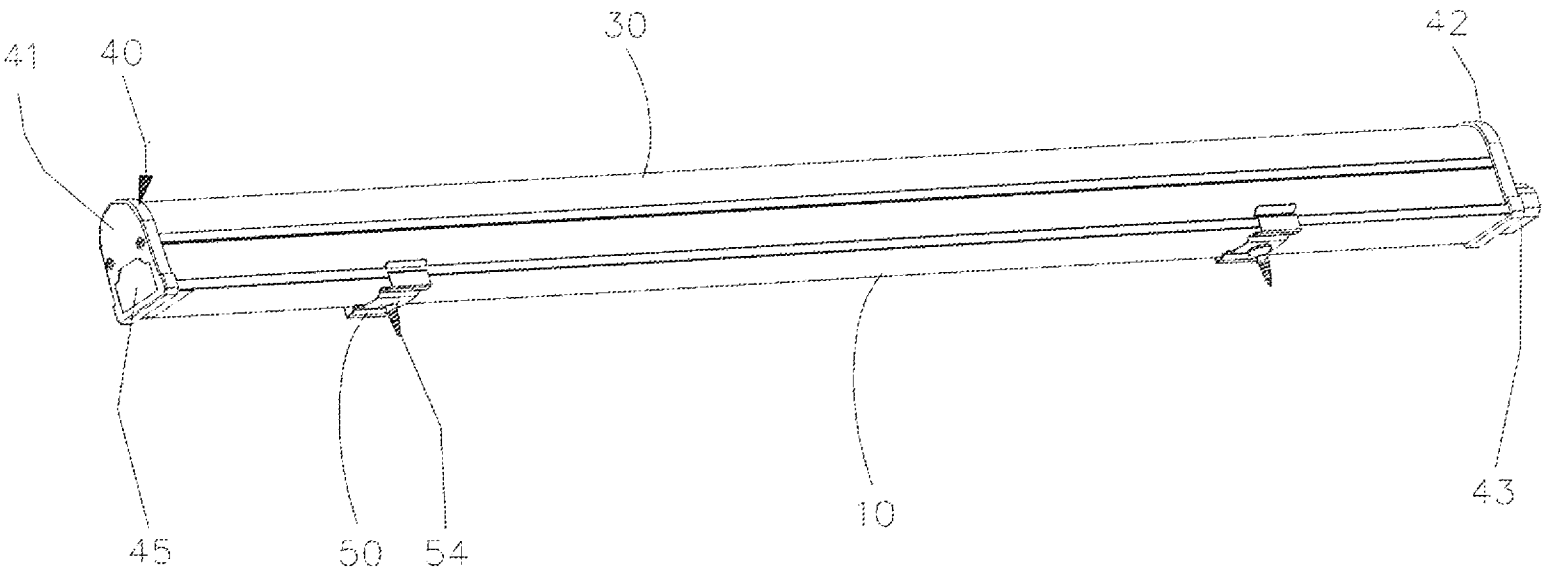
FIG. 2 is similar to FIG. 1, but viewed from another aspect.
Figure 3:
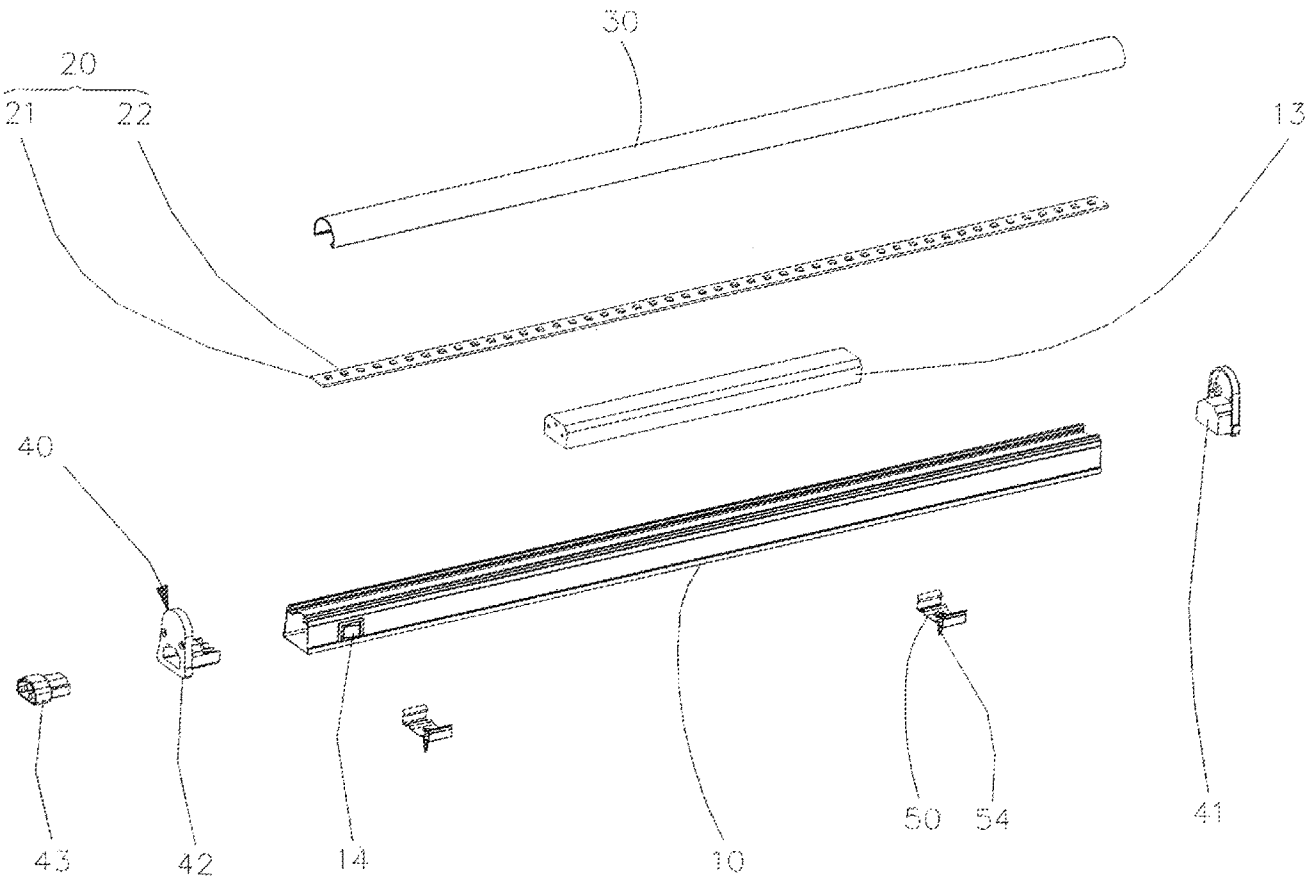
FIG. 3 is an exploded view of the quick installation LED lamp of FIG. 1.

Referring to FIG. 1 through FIG. 3, a quick installation LED lamp according to an embodiment includes an aluminum profile 10, a light source assembly 20 mounted inside the aluminum profile 10, a lampshade 30 mounted on the aluminum profile 10, and a connector assembly 40. When the quick installation LED lamp is energized, the light source assembly 20 emits bright light, which is radiated to the outside through the lampshade 30, thus achieving the lighting effect.

Figure 4:
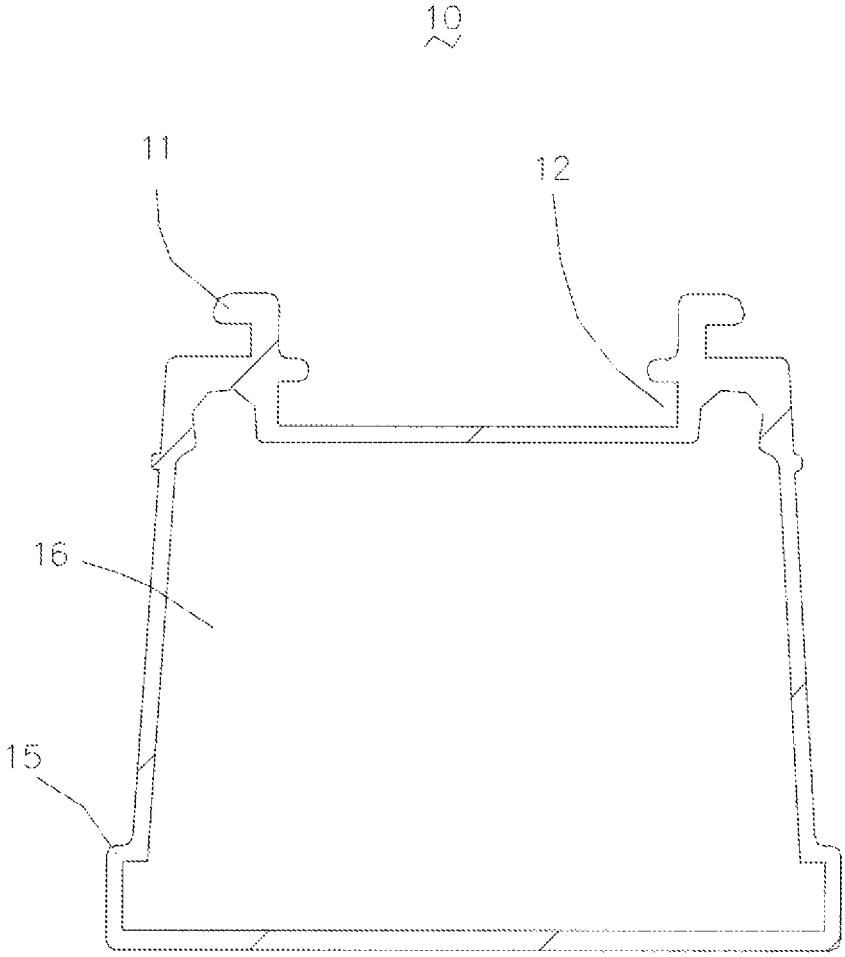
FIG. 4 is a cross-sectional view of an aluminum profile of FIG. 3.

Referring to FIG. 4, in the illustrated embodiment, the aluminum profile 10 has a cross-section shaped as a rectangular ring. The aluminum profile 10 has two opposed hooks 11 on a top surface thereof, which are used to engage the lampshade 30. The aluminum profile 10 defines a groove 12 on the top thereof and between the two hooks 11. The groove 12 is adapted to accommodate the light source assembly 20. The aluminum profile 10 has two opposed abutting portions 15 at both bottom sides thereof. The aluminum profile 10 has a cavity 16 formed therein. A driving power source 13 coupled to external power supply is located inside the cavity 16. The driving power source 13 is electrically coupled to the light source assembly 20 to provide energy for it. A switch 14 is provided on a side of the aluminum profile 10. The switch 14 is electrically coupled between the driving power source 16 and the light source assembly 20, so as to control on and off of the light source assembly 20.

The light source assembly 20 includes a support strip 21 and a plurality of LED beads 22 arranged spaced and equidistantly on the support strip 21. In the illustrated embodiment, the support strip 21 is an elongated aluminum strip having good thermal conductivity, electrical insulating properties and machinability. The LED beads 22 are connected in parallel, such that the overall luminous reliability of the circuit can be ensured when a single LED bead fails.

The lampshade 30 is mounted on the aluminum profile 10 and covers the light source assembly 20. The lampshade 30 has a roughly semi-circular cross-section. The lampshade 30 has two opposed protrusions 31 (shown in FIG. 10) at both ends thereof. The two protrusions 31 can be engaged with the two hooks 11, respectively, so as to fix the lampshade 30 to the aluminum profile 10. An outer surface of the lampshade 30 is a smooth arc, and its inner surface is provided with wavy stripes arranged in a width direction. Such configuration can make the light more gentle and reduce the glare phenomenon.

Figure 5:
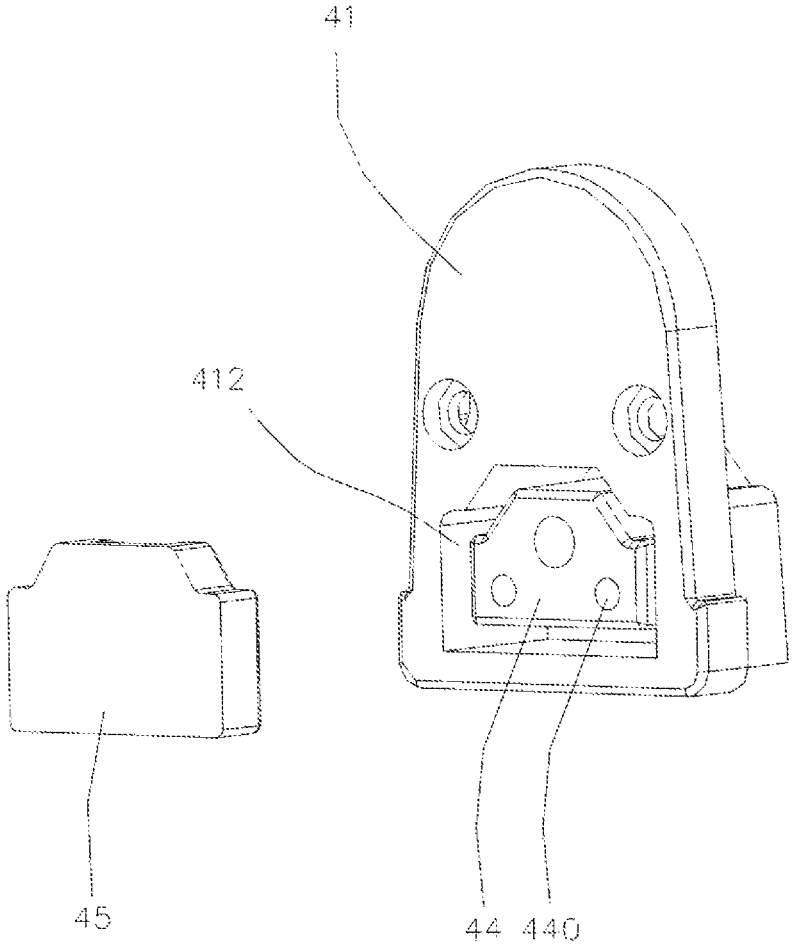
FIG. 5 is a perspective view of a male end cap of FIG. 3.
Figure 6:
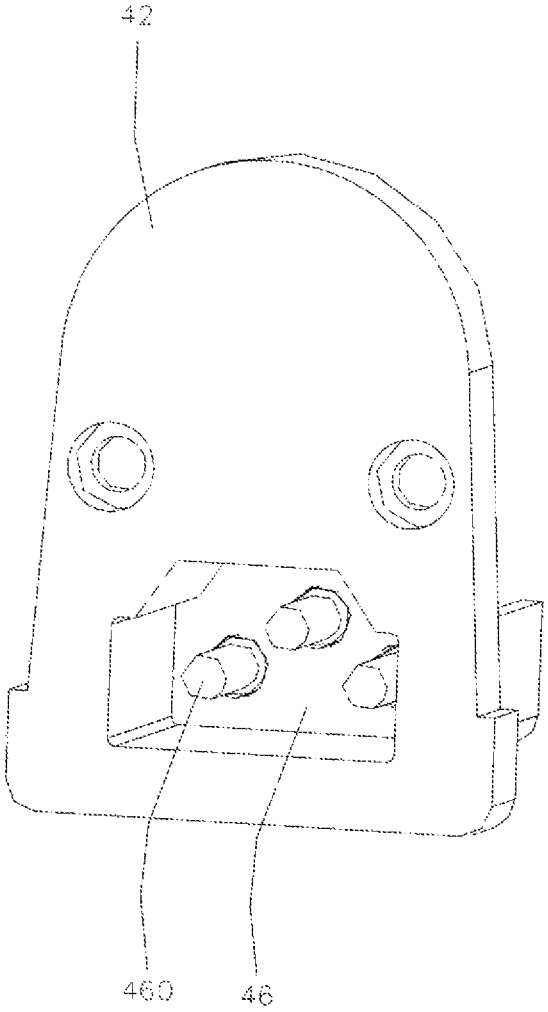
FIG. 6 is a perspective view of a female end cap of FIG. 3.
Figure 7:
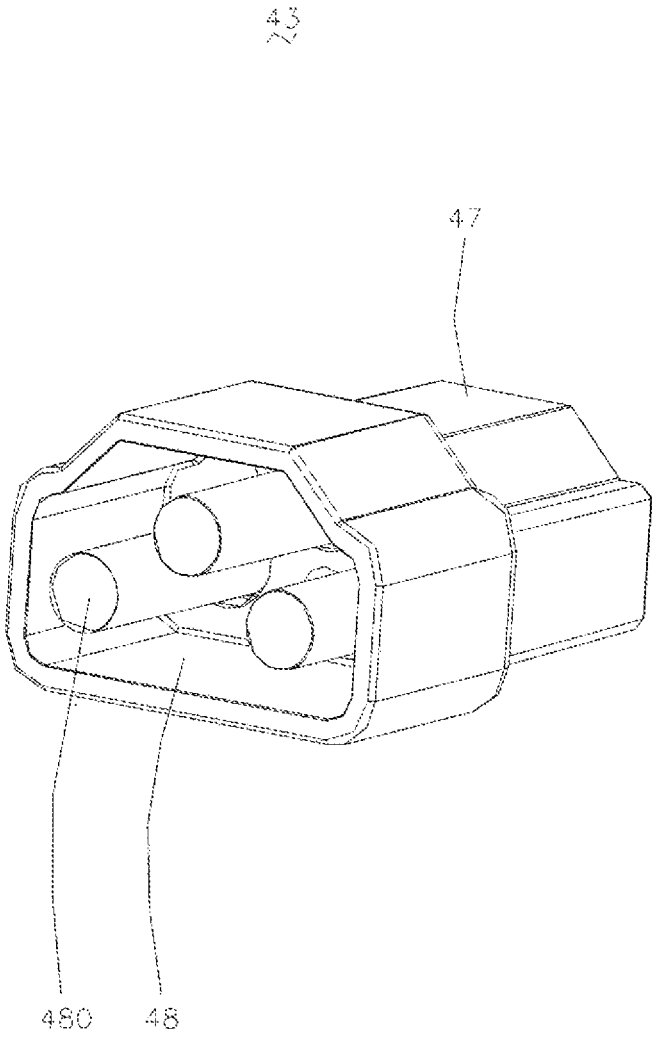
FIG. 7 is a perspective view of a connector of FIG. 3.

Referring to FIG. 5 through FIG. 7, the connector assembly 40 includes a male end cap 41 located at one end of the aluminum profile 10, a female end cap 42 located at the other end of the aluminum profile 10, and a connector 43, which can be inserted in the female end cap 42. The male end cap 41 defines a substantially rectangular opening 412 on a side thereof. A first plug 44 is located in the opening 412. The first plug 44 has three first jacks 440 formed on a side thereof. In order to avoid electric shock caused by user direct contacting the first plug 44, in one embodiment, the male end cap 41 is provided with a cover plate 45 to shield the first plug 44. The cover plate 45 can be fit in the opening 412, thus preventing the first plug 44 from exposure.

The female end cap 42 has a similar shape to that of the male end cap 41. The female end cap 42 is provided with a first receptacle 46 on a side thereof. A plurality of first pins 460 are located at the bottom of the first receptacle 46. In the illustrated embodiment, there are three first pins 460.

Figure 8:
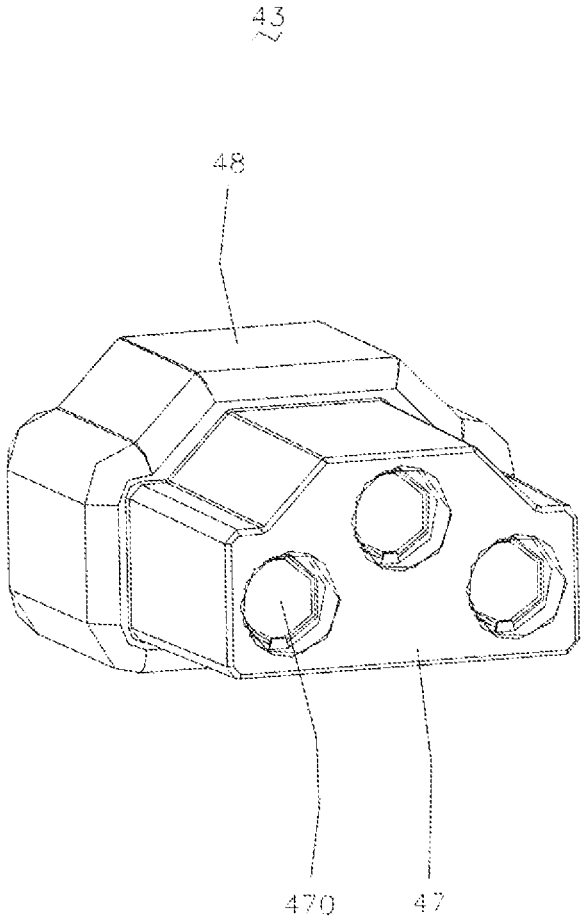
FIG. 8 is similar to FIG. 8, but viewed from another aspect.

Referring to FIG. 7 and FIG. 8, the connector 43 includes a second plug 47 on the one side and a second receptacle 48 on the other side. The second plug 47 and the second receptacle 48 are opposite to each other. In the illustrated embodiment, the second plug 47 has three second jacks 470. The first and second plugs 44, 47 have exactly the same shape, and the first and second jacks 440, 470 have the same shape and corresponding lactations. Specifically, the second plug 47 can be inserted into the first receptacle 46 of the female end cap 42, and the first pins 460 are accommodated in the second jacks 470. Similarly, the second receptacle 48 of the connector 43 can accommodate the first plug 44 of the male end cap 41, and the second pins 480 are accommodated in the first jacks 440. Alternatively, the second receptacle 48 can be coupled to external power source.

Upon assembly, the plurality of quick installation LED lamps can be connected one by one via the connectors 43. Specifically, the second plug 47 of the connectors 43 is coupled to the first receptacle 46 of one quick installation LED lamp, while the second receptacle 48 of the connectors 43 is coupled to the first plug 44 of another quick installation LED lamp.

Figure 9:
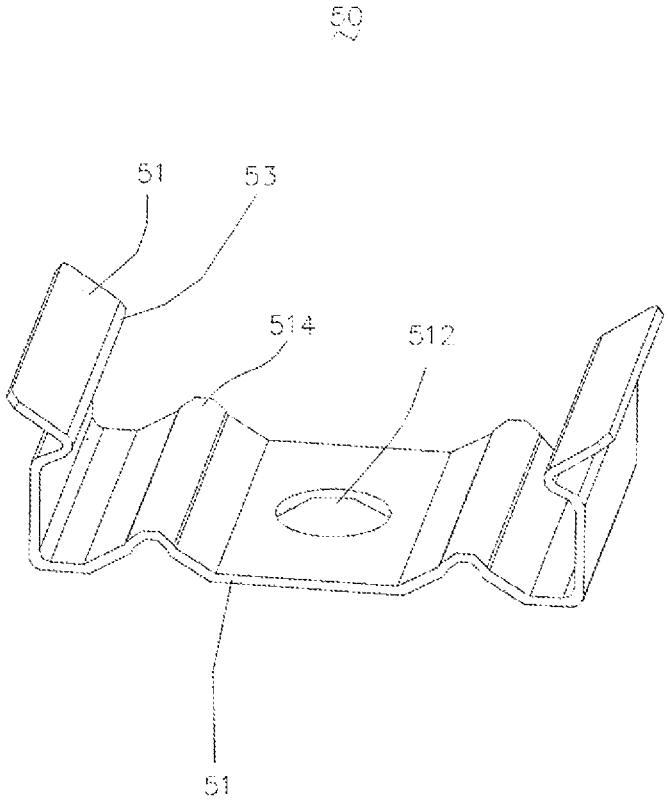
FIG. 9 is a perspective view of a fixing piece of FIG. 3.
Figure 10:
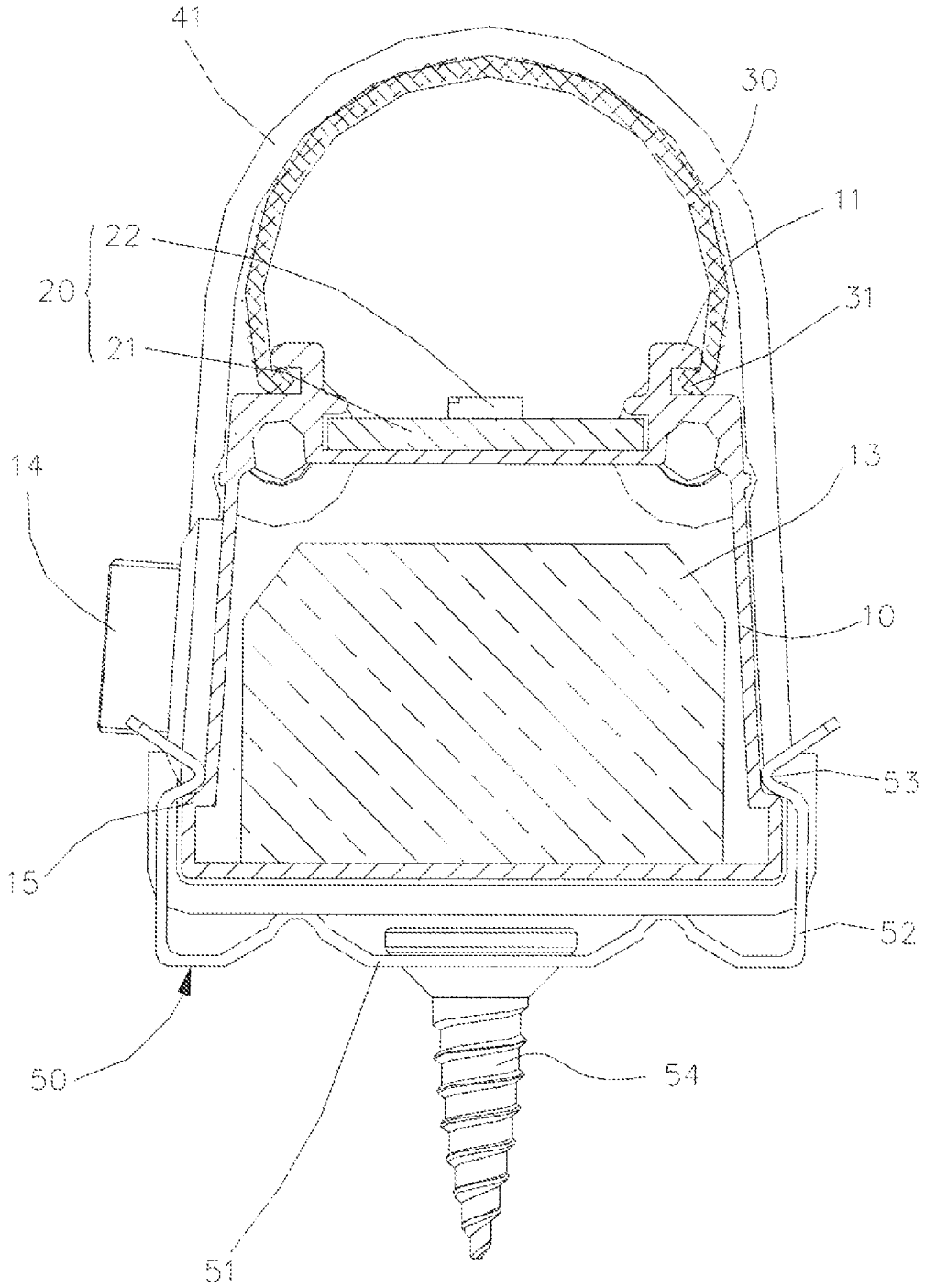
FIG. 10 is a cross-sectional view of the quick installation LED lamp of FIG. 1.

Referring to FIG. 9 and FIG. 10, the quick installation LED lamp further includes two fixing pieces 50. In the illustrated embodiment, the fixing piece 50 is a single metal piece formed by stamping. The fixing piece 50 includes a W-shaped base plate 51 and the two side plates 52 extending upwardly from both sides of the base plate 51. Each side plate 52 has a bending portion 53, which is elastic. Two bending portions 53 are opposite to each other. The base plate 51 defines a mounting hole 512 on a middle portion thereof. The base plate 51 further has two protrusion portions 514 located on both sides of the mounting hole 512. Upon assembly, the fixing piece 50 can be fastened to a wall or the like by a screw 54 extending through the mounting hole 512. The aluminum profile 10 is then mounted on the fixing piece 50. Since the two side plates 52 are elastic, when aluminum profile 10 is inserted between two side plates 52, the two bending portions 53 of the fixing piece 50 can be latched with two abutting portions 15 of the aluminum profile 10, respectively, and the bottom surface of the aluminum profile 10 are supported by the two protrusion portions 514. Therefore the aluminum profile 10 can be securely mounted on the fixing piece 50, thus saving the installation time and improving the mounting efficiency.

According to foregoing quick installation LED lamp, since the male end cap 41 and the female end cap 42 are provided at both ends of the aluminum profile 10, the plurality of quick installation LED lamps can be connected one by one via the connectors 43. In addition, the aluminum profile 10 can be clamped and secured on the fixing piece 50. By adjusting the distance between the fixing pieces 50, it is more convenient and practical to adapt to the aluminum profile 10 of different lengths.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Although the description is illustrated and described herein with reference to certain embodiments, the description is not intended to be limited to the details shown. Modifications may be made in the details within the scope and range equivalents of the claims.

What is claimed is:

1. A quick installation LED lamp, comprising:

an aluminum profile having a groove on a top thereof, the aluminum profile being provided with an abutting portion on a bottom thereof;

a light source assembly received in the groove, the light source assembly comprising a support strip and a plurality of LED beads arranged spaced and equidistantly on the support strip;

a lampshade mounted on the aluminum profile and covering the light source assembly;

a connector assembly comprising:

a male end cap located at one end of the aluminum profile, the male end cap being provided with a first plug having a plurality of first jacks;

a female end cap located at the other end of the aluminum profile, the female end cap being provided with a first receptacle, the first receptacle being provided with a plurality of first pins mounted therein; and a connector comprising a second plug and a second receptacle opposite to the second plug, the second plug having a plurality of second jacks, the second receptacle being provided with a plurality of second pins mounted therein; wherein the second plug is configured to be inserted into the first receptacle; the plurality of first pins are accommodated in the second jackets; the second receptacle is configured to accommodate the first plug; the plurality of first second pins are inserted in the first jackets; and a fixing piece having a base plate and the two side plates extending upwardly from both sides of the base plate, wherein the side plate has a bending portion latching with the abutting portion.

2. The quick installation LED lamp according to claim 1, further comprising a driving power source located inside the aluminum profile, wherein the driving power source is electrically coupled to the light source assembly.

3. The quick installation LED lamp according to claim 2, further comprising a switch located on a side of the aluminum profile, wherein the switch is electrically coupled between the driving power source and the light source assembly.

4. The quick installation LED lamp according to claim 1, wherein the first and second plugs have the same shape; the first and second jacks have the same shape.

5. The quick installation LED lamp according to claim 1, wherein the first and second receptacles have the same shape; the first and second pins have the same shape.

6. The quick installation LED lamp according to claim 1, wherein the base plate has a mounting hole, the fixing piece is fixed to a wall via a screw extending through the mounting hole.

7. The quick installation LED lamp according to claim 1, wherein the male end cap is provided with a cover plate to shield the first plug.

* * * * *